US005816980A

United States Patent [19]

Myszka et al.

[11] Patent Number: 5,816,980

[45] Date of Patent: Oct. 6, 1998

[54] PLAYGROUND ASSEMBLY

[75] Inventors: Kevin E. Myszka, Copley; Travis D. Shamp, Cuyahoga Falls; Anthony R. Smith, Elyria, all of Ohio

[73] Assignee: The Little Tikes Company, Hudson, Ohio

[21] Appl. No.: 758,235

[22] Filed: Nov. 27, 1996

[51] Int. Cl.[6] ..... A63B 9/00

[52] U.S. Cl. ..... 482/35; D21/244

[58] Field of Search ..... 482/35, 36; D21/244, D21/245

[56] References Cited

U.S. PATENT DOCUMENTS

| | | | |
|---|---|---|---|
| D. 244,556 | 5/1977 | Burgess et al. | D21/245 |
| D. 303,826 | 10/1989 | Aker | D21/243 |
| D. 343,438 | 1/1994 | Fish, Jr. | D21/244 |
| D. 344,773 | 3/1994 | Aker et al. | D21/244 |
| D. 355,692 | 2/1995 | Houry et al. | D21/244 |
| D. 355,693 | 2/1995 | Aker et al. | D21/244 |
| D. 367,911 | 3/1996 | van Huystee | D21/244 |
| D. 368,510 | 4/1996 | Ford | D21/244 |
| 5,226,864 | 7/1993 | Showers | 482/35 |

FOREIGN PATENT DOCUMENTS

| | | | |
|---|---|---|---|
| 389152A | 9/1990 | European Pat. Off. | 482/35 |
| 604351A2 | 6/1994 | European Pat. Off. | 482/35 |

OTHER PUBLICATIONS

Feber, Activity Park–Outdoor Collection Product Brochure Juguetes Feber, S.A. (1993).

*Iron Mountain Forge* Buyer's Guide, 17th Edition, 9 pages, (1994).

Little Tikes Product No. 1553, Peek–A–Boo Activity Tunnel (Jun. 1995).

Little Tikes Product No. 4023, Cave Climber (May 1990).

Little Tikes Product No. 4024, Climb 'N Slide Treehouse (Jun. 1990).

Little Tikes Product No. 4108/4448, Play Slide (Mar. 1994).

Little Tikes Product No. 4126, Castle, (1/95).

Little Tikes Product No. 4301, Tike Treehouse (Oct. 1990).

Little Tikes Product No. 4380, Waveclimber (May 1993).

Little Tikes Product No. 4390, Little Tikes Playground (Sep. 1993).

Little Tikes Product No. 4422, Space Station (Jun. 1995).

Little Tikes Product No. 4551, Water Wave Slide (Nov. 1994).

Little Tikes Product No. 4639, Skycenter Playhouse Climber (Nov. 1995).

Little Tikes Product No. 4659, Timbertop Treehouse Climber (Jan. 1996).

Little Tikes Product No. 4661, Twin Slide Tunnel Climber (Dec. 1995).

Little Tikes Product No. 4391/4701, Activity Gym (Sep. 1993).

Little Tikes Product No. 4719, Junior Activity Gym (Jul. 1993).

Little Tikes Product No. 4918, Big Slide (Feb. 1989).

(List continued on next page.)

*Primary Examiner*—Richard J. Apley
*Assistant Examiner*—William La Marca
*Attorney, Agent, or Firm*—Renner, Kenner, Greive, Bobak, Taylor & Weber

[57] ABSTRACT

A playground assembly (10) includes a playhouse structure (11) having a plurality of walls (16, 17, 18, 19) and a tower structure (12) having a plurality of walls (29, 30, 31, 32). A tunnel member (15) may be selectively attached between appropriately configured playhouse walls (16, 17) and appropriately configured tower walls (29, 30, 31) by positioning its lug assemblies (91) through notches (92) formed in a selected window (20, 23, 33, 35, 36) and rotating the tunnel member (15) so that the notches (92) traverse ramped surfaces (95) and engage a stop surface (96). Playground assembly (10) also includes a slide (14) which may be selectively attached to appropriately configured playhouse and tower walls (19, 29, 31). To that end, windows (26, 34, 37) in the walls (19, 29, 31) are provided with lugs (109, 110) and the slide (14) is provided with channels (102, 103) which snap over the lugs (109, 110) to attach the slide (14) selectively to one of the walls (19, 29, 31).

26 Claims, 6 Drawing Sheets

OTHER PUBLICATIONS

Fisher Price Model Number 5990, Adjustable Playhouse Gym (1994).
Burke Catalog, 4 pages (1992).
The Children's Factory Catalog, 1 page (1986–1988).
Miracle Recreation Equipment Company, *Follow The Leader*, 1995 Park & Playground Catalog, 2 pages.
GameTime Park & Playground 1995 Catalog, 4 pages.
Kaplan School Supply Corp. Catalog, 1 page, (1986–1987).
Landscape Structures Inc. Park & Playground Equipment Catalog, 3 pages, (1991).
Paris Catalog, 6 pages (Sep. 1993).
Quality Industries, Inc. *We Turn Children's Dreams Into Reality* Catalog, 4 pages (1994).

PLAYGROUND ASSEMBLY

TECHNICAL FIELD

This invention relates to a playground assembly for children. More particularly, this invention relates to such a playground assembly which can be readily assembled in a variety of configurations without the need for any hardware or fasteners.

BACKGROUND ART

Playground assemblies having multiple structures in which a child may play are well known in the art. Moreover, it is well known to provide such assemblies with at least one slide positionable on one of the structures and with a tunnel or passageway mounted between the structures.

Most known playground assemblies are constructed of multiple components which must be assembled by the user. In all such assemblies, many of the components must be attached by hardware or mechanical fasteners such as bolts, screws, or the like. Such renders the assembly process more tedious and time-consuming, and renders the playground assembly, itself, more expensive.

In addition, once known playground assemblies are assembled, the position of their components is permanent. Such provides the child with only one playground toy which, after some use, could become boring to the child.

The need exists, therefore, for a playground assembly which can be put together by the user without the use of any hardware or fasteners and at the same time, can be readily assembled in a wide variety of configurations for the enjoyment of the children playing in the assembly.

DISCLOSURE OF THE INVENTION

It is thus an object of the present invention to provide a playground assembly which can be totally assembled without the need of any hardware or mechanical fasteners.

It is another object of the present invention to provide a playground assembly, as above, in which the components thereof can be assembled in a wide variety of different positions so as, in effect, to provide a multiplicity of playground assemblies for the child.

It is a further object of the present invention to provide a playground assembly, as above, with multiple structures and a slide which can be selectively positioned at multiple locations on the structures.

It is an additional object of the present invention to provide a playground assembly, as above, with a passageway or tunnel which can be selectively positioned at multiple locations between the structures.

It is yet another object of the present invention to provide a playground assembly, as above, in which the tunnel may also be utilized as a walkway between the structures.

These and other objects of the present invention, as well as the advantages thereof over existing prior art forms, which will become apparent from the description to follow, are accomplished by the improvements hereinafter described and claimed.

In general, a playground assembly made in accordance with one aspect of the present invention includes a first structure having a plurality of walls and a second structure having a plurality of walls. A tunnel member is attachable between selected of the walls of the first structure and selected of the walls of the second structure.

In accordance with another object of the present invention, the playground assembly is provided with a slide member which is attachable to selected of the walls of the first and second structures.

A preferred exemplary playground assembly incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
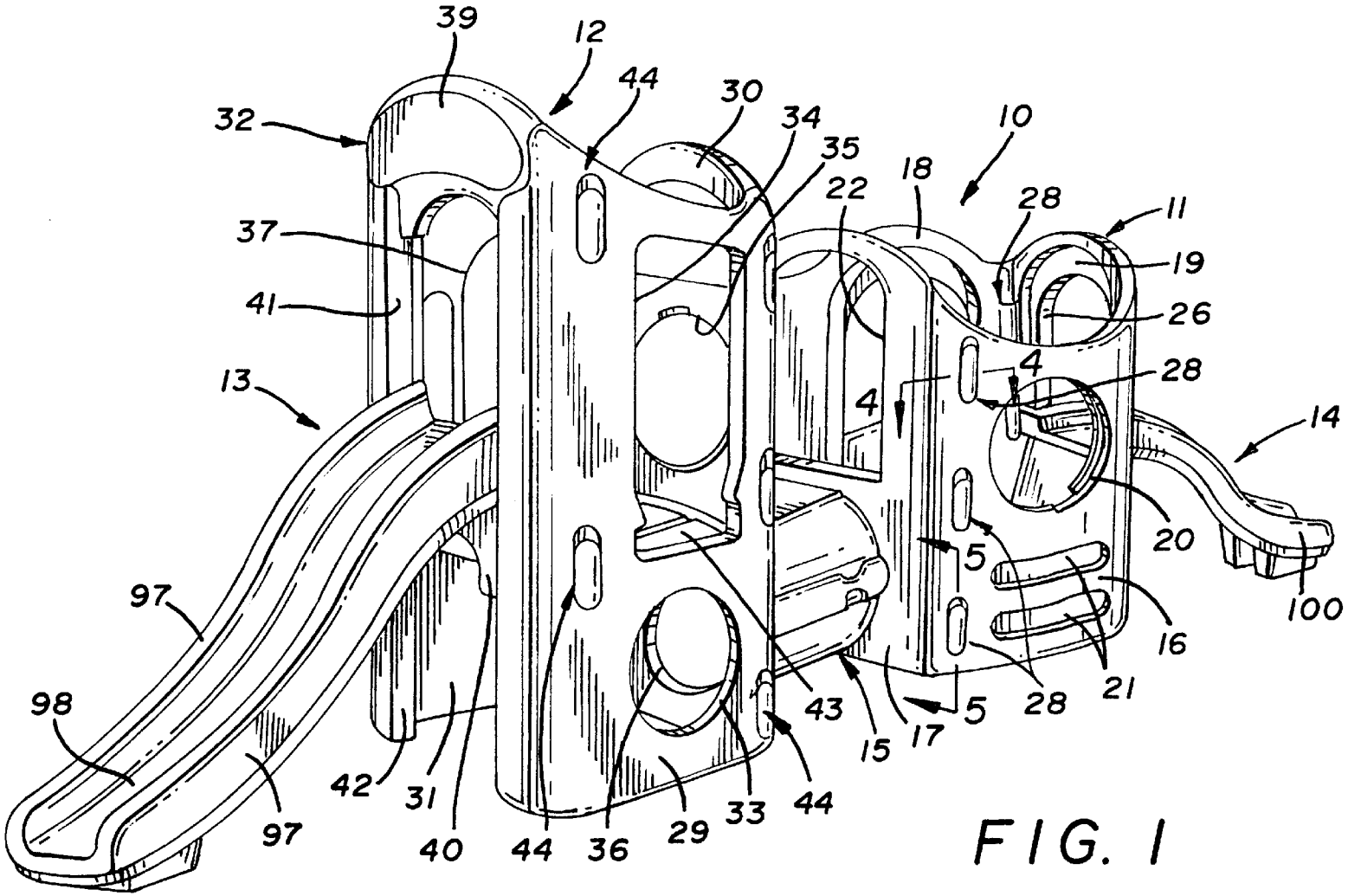
FIG. 1 is a somewhat schematic perspective view of an assembled playground assembly made in accordance with the concepts of the present invention.

A playground assembly made in accordance with the concepts of the present invention is shown in one assembled condition in FIG. 1 and is indicated generally by the numeral 10. Playground assembly 10 can be molded of any suitable plastic and includes a plurality of free-standing structures, with two such structures being shown. One such structure can be considered a playhouse and is generally indicated by the numeral 11, and the other structure can be considered a tower and is generally indicated by the numeral 12. Of course, other compatibly configured free-standing structures could be employed to create a larger playground assembly 10, if desired.

Playground assembly 10 is also provided with other components which can be attached to playhouse 11 and/or tower 12. Such components can include slides generally indicated by the numerals 13 and 14 and a tunnel assembly generally indicated by the numeral 15. Tunnel assembly 15 generally extends between playhouse 11 and tower 12, as will hereinafter be described, and in a situation where more than two free-standing structures are provided, a plurality of tunnel assemblies 15 could also be provided to extend between selected of the structures.

Figure 3:
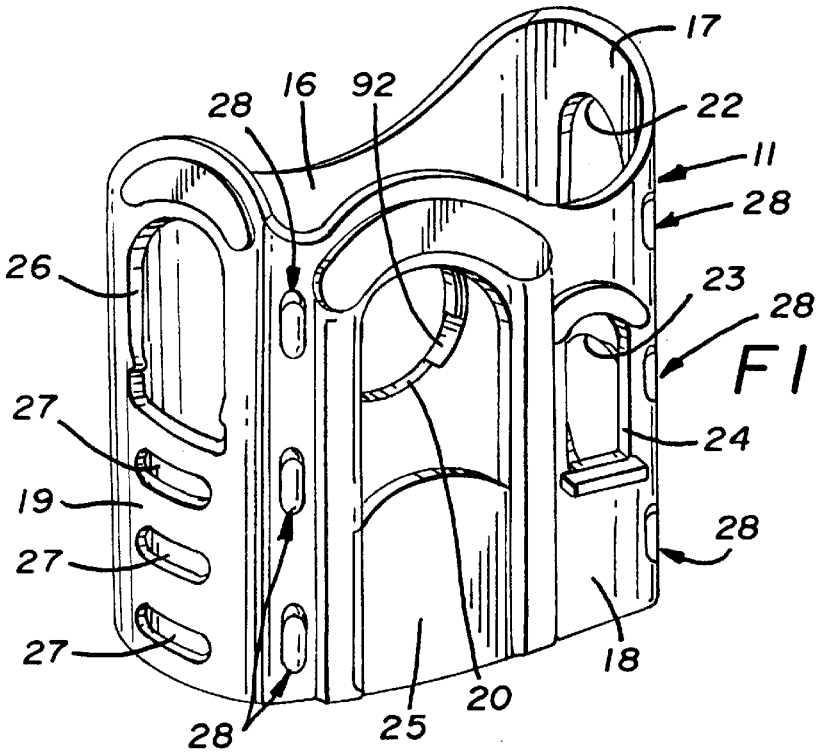
FIG. 3 is a somewhat schematic perspective view of the other structure of the playground assembly showing the walls thereof opposite to those that fully appear in FIG. 1.

As shown in FIGS. 1 and 3, playhouse 11 is formed with four interconnected walls 16, 17, 18 and 19 which can take on a variety of configurations and which can include a variety of features. Thus, wall 16 includes in its upper portion a tunnel-receiving aperture 20 and is connected between walls 17 and 19. Wall 16 also includes a plurality of elongate apertures 21 below aperture 20 which act as foot holes so that a child may climb wall 16 for easy access to tunnel-receiving aperture 20. Wall 17, which is connected between walls 16 and 18, can be provided with a window 22 in its upper portion and a tunnel-receiving aperture 23 in its lower portion. As best shown in FIG. 3, wall 18, which is connected between walls 17 and 19, can be provided with a window 24 and a door 25 which may be opened on a hinge structure to provide one manner of ingress to and regress from playhouse 11. Finally, wall 19 is shown as having a slide-receiving window 26 near to the top thereof and a plurality of elongate apertures 27 below window 26 which act as foot holes so that a child may climb wall 19 to gain access to window 26. The lateral edges of walls 16, 17, 18 and 19 are selectively provided with male/female connection assemblies, generally indicated by the numeral 28 and to hereinafter described.

Figure 2:
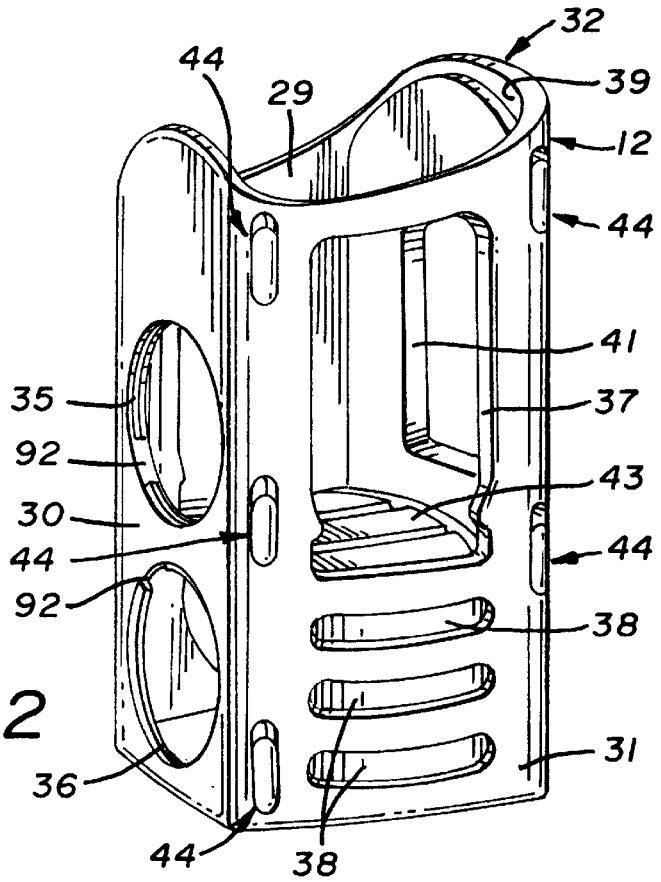
FIG. 2 is a somewhat schematic perspective view of one of the structures of the playground assembly showing the walls thereof opposite to those that fully appear in FIG. 1.

As shown in FIGS. 1 and 2, tower 12 is formed with interconnected walls 29, 30, 31 and a wall-like structure generally indicated by the numeral 32. As described with respect to playhouse 11, these walls can be provided with a wide variety of selected features, with typical features being shown. Thus, wall 29 can be provided with a tunnel-receiving aperture 33 in its lower portion and a slide-receiving window 34 in its upper portion above aperture 33. Wall 30, which is connected between walls 29 and 31, is shown as having an upper tunnel-receiving aperture 35 and a lower tunnel-receiving aperture 36. Wall 31 is shown as having a slide-receiving window 37 in its upper portion with a plurality of elongate apertures 38 therebelow which act as foot holes so that a child may climb wall 31 to gain access to window 37. Wall-like structure 32, which could merely be in the form of an actual wall similar to walls 29, 30 and 31, is rather shown as including an arch member 39 which spans across the top and is connected between walls 29 and 31. In addition, a slide-receiving brace 40 is mounted generally midway between walls 29 and 31. As such, a slide access opening 41 is formed between arch member 39 and brace 40, and an ingress/regress opening 42 to tower 12 is formed below brace 40. Brace 40 also carries a platform 43 which extends into tower 12 and generally fills the space centrally between walls 29, 30 and 31 and wall-like structure 32. A child may sit or stand on platform 43 for access to window 34 of wall 29, tunnel-receiving aperture 35 of wall 30, slide-receiving window 37 of wall 31, and slide access opening 41 of wall-like structure 32. The lateral edges of walls 29, 30 and 31, as well as arch member 39 and brace 40, can be selectively provided with male/female connection assemblies, generally indicated by the numeral 44 and now to be described with specific reference to FIGS. 4 and 5.

Figure 4:
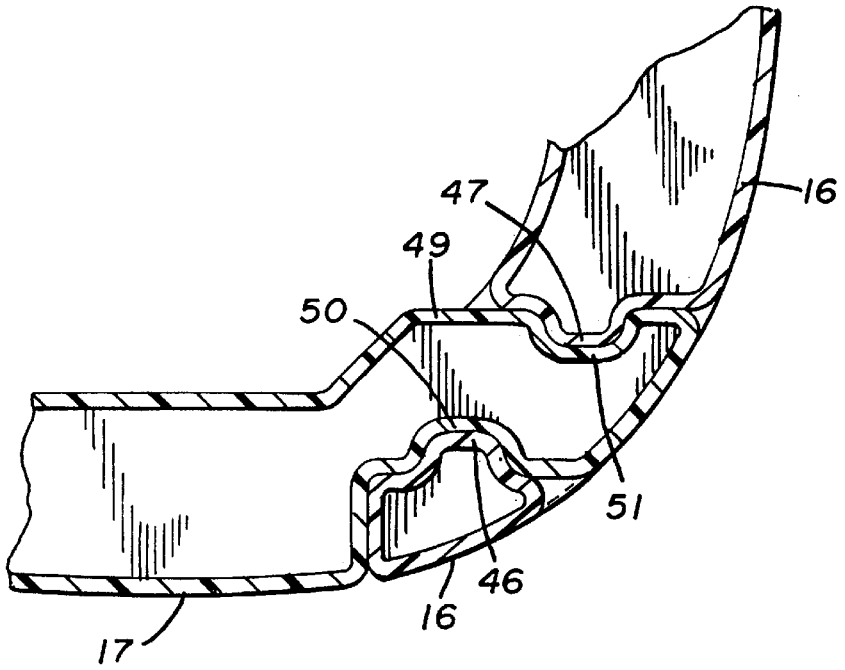
FIG. 4 is a fragmented sectional view taken substantially along line 4—4 of FIG. 1.

Male/female connection assemblies 28 and male/female connection assemblies 44 are generally identical and thus only one need be described herein. In all such connection assemblies, tabs carried by one wall are received in slots formed in the adjacent wall. For example, in playhouse 11, walls 17 and 19 can be provided with such tabs, and walls 16 and 18 can be provided with the receiving slots. Similarly, in tower 12, wall 30, arch 39 and brace 40 may be provided with similar lugs, and walls 29 and 31 can be provided with the receiving slots. Thus, the description of one of the male/female connection assemblies 28 assisting in the connection of wall 16 to wall 17 of playhouse 11, as shown in FIGS. 4 and 5, applies to all connection assemblies 28 and 44.

Figure 5:
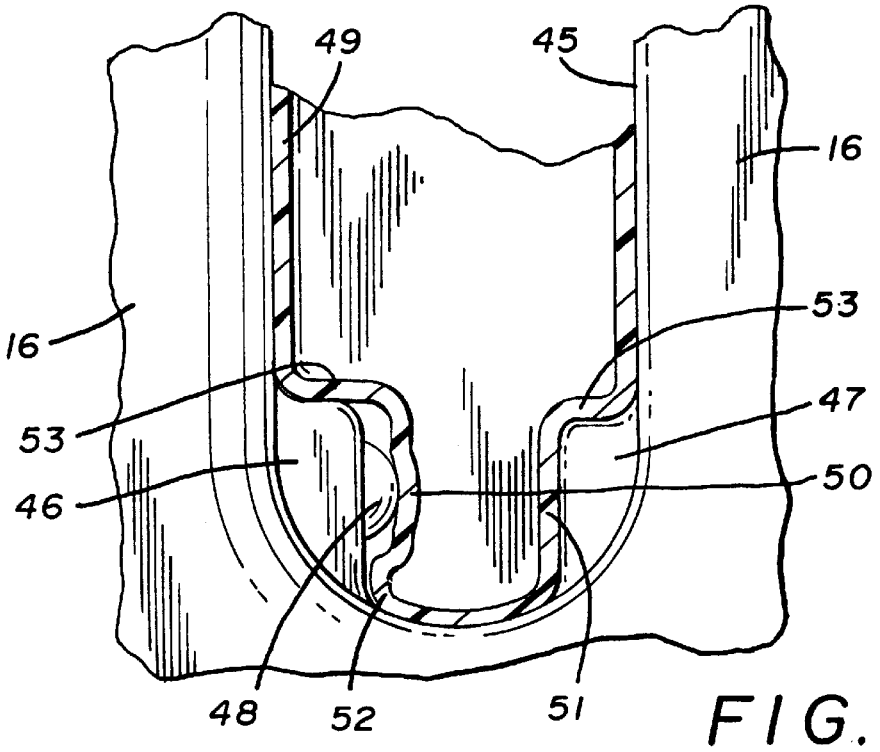
FIG. 5 is a fragmented sectional view taken substantially along line 5—5 of FIG. 1.

In FIG. 5, it is shown that wall 16 is provided with a generally vertical slot 45 having opposed and offset ribs 46, 47 formed at the bottom thereof. A lug 48 projects inwardly from rib 46. Each end of wall 17 is provided with a laterally extending tab 49 which near the bottom thereof, are provided with tracks 51 in which ribs 46, 47, respectively, are received. A hook portion 52 is provided near the bottom of track 50 and as tab 49 is being pushed into slot 45 (downwardly in FIG. 5), hook portion 52 snaps over lug 48 to lock walls 16 and 17 together. Also at that time, shoulder 53 formed at the transition between tracks 50, 51 and the bottom of tab 49 rest against the top of ribs 46, 47. Thus, by inserting the tabs of all of the walls having them into the slots of all walls having them, and merely pushing downwardly on the walls having tabs, playhouse 11 and tower 12 can be assembled.

The tunnel assembly 15 component of playground assembly 10 will now be described with primary reference to FIG. 6. As shown, tunnel assembly 15 is preferably most conveniently molded as two tunnel segments generally indicated by the numerals 60 and 61. Tunnel segment 60 includes semicircular end flanges 62, 63 having semicircular collars 64, 65, respectively. The edges of flanges 62, 63 are provided with lug portions 66, 67, respectively. Tunnel segment 60 also includes a body portion having a substantially flat surface 68 extending longitudinally between collars 64 and 65 and somewhat wave-like side surfaces 69, 70 also extending between collars 64 and 65 and from the side edges of surface 68. Side surfaces may be supplied with additional reinforcement by means of conventional conical and/or oval irregularities 71 (one shown in FIG. 6) being formed therein. A plurality of tabs 72, preferably four (three shown in FIG. 6) extend from and beyond the edges of side surfaces 69, 70. Each tab 72 has an outer bevelled edge 73 and carries a lock barb 74 to engage tunnel segment 61 now to be described.

Tunnel segment 61 includes semicircular end flanges 75, 76 having semicircular collars 77, 78, respectively. The edges of flanges 75, 76 are provided with lug portions 79, 80, respectively. Tunnel segment 61 also includes a body portion having a substantially flat surface 81 extending horizontally between collars 77 and 78 and somewhat wave-like side surfaces 82, 83 also extending between collars 77 and 78 and from the side edges of surface 81. Side surfaces may be supplied with additional reinforcement by means of conventional conical and oval irregularities 84 being formed therein. Tunnel segment 61 is also provided with flaps 85 extending beyond the edges of side surfaces 82, 83. Flaps 85 are spaced from side surfaces 82, 83 to form longitudinally extending pockets 86 (one shown in FIG. 6). Recessed areas 87 are formed in flaps 85 facing inwardly toward pockets 86, the top of each of which having dished-out areas 88. Complementary recessed areas 89 are formed in side surfaces 82, 83 adjacent to and below flap recessed areas 87 at the approximate location where flaps 85 join side surfaces 82, 83. A through notch 90 is also formed in each flap 85.

Figure 6:
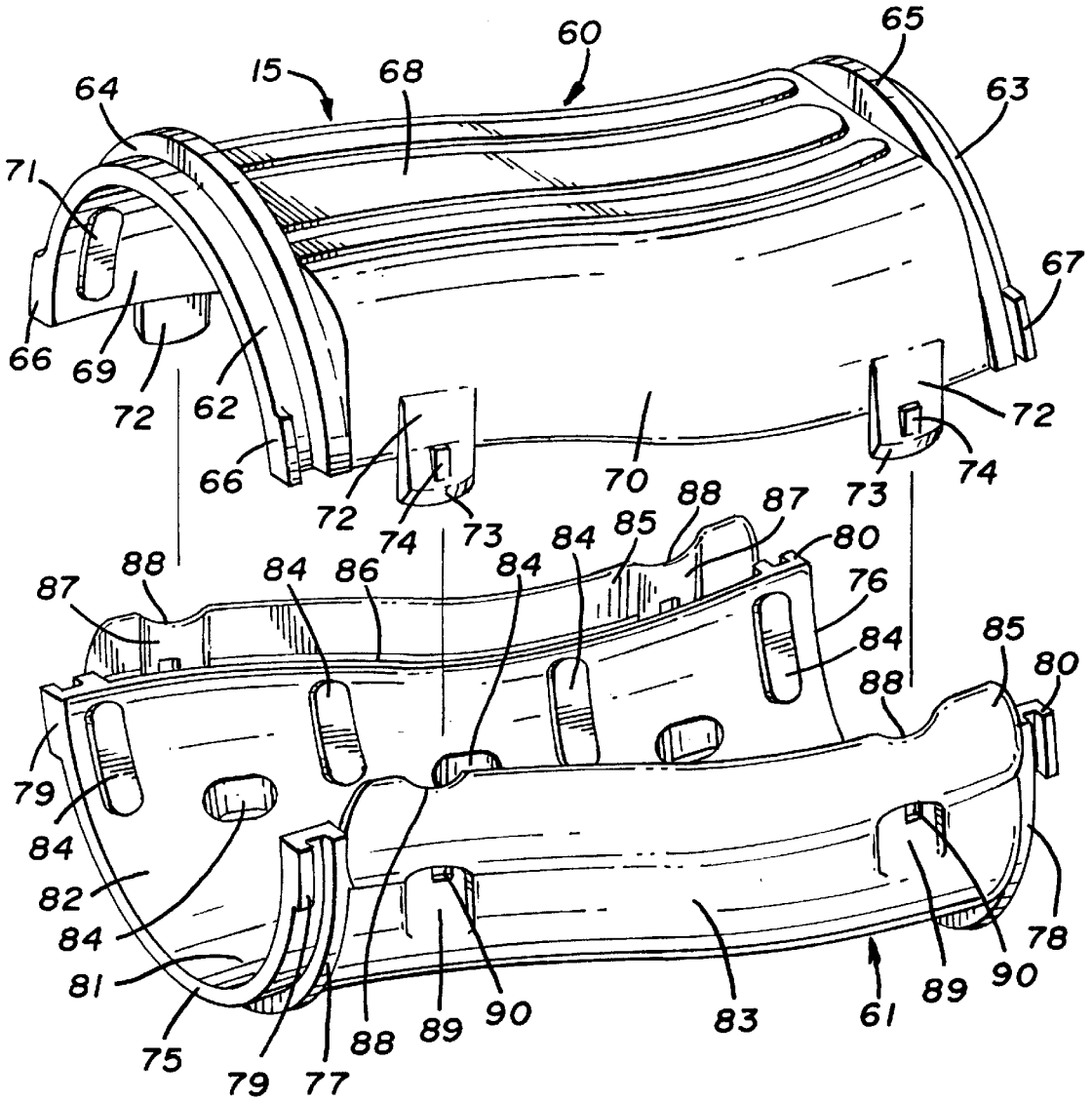
FIG. 6 is an exploded perspective view showing the two-part tunnel which is one component of the playground assembly shown in FIG. 1.
Figure 7:
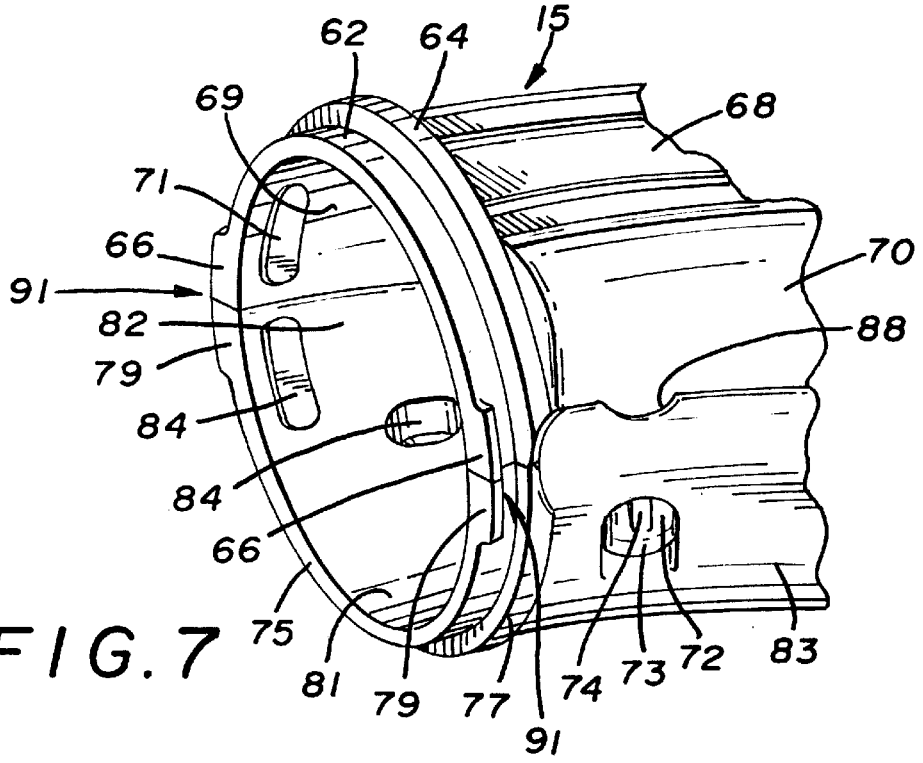
FIG. 7 is a fragmented perspective view of an end of the assembled tunnel which is received by a selected wall of either of the structures shown in FIGS. 2 and 3.

Tunnel segments 60 and 61 are attached together to form tunnel assembly 15 merely by aligning them, as shown in FIG. 6, and inserting the tabs 72 into the recessed areas 87. Dished out areas 88 provide clearance for this movement and eventually lock barbs 74 of tabs 72 snap through notches 90 of flaps 85 to secure segments 60 and 61 together to form tunnel assembly 15, one end of which is shown in FIG. 7. When formed, tunnel assembly 15 thus includes larger diametrically opposed lug assemblies 91 at each end thereof formed by the mating of lug portions 66 and 79 and lug portions 67 and 80. Also, tunnel assembly 15 has two opposed substantially flat outer surfaces 68, 81 and two curved sides formed by the mating of surfaces 69 and 82 and surfaces 70 and 83.

Tunnel assembly 15 can be assembled with playhouse 11 and tower 12 in three different locations to provide a playground assembly 10 with a variety of configurations. There are two lower tunnel attachment options, one of which being shown in FIG. 1 wherein tunnel assembly 15 communicates with tunnel-receiving aperture 23 of wall 17 of playhouse 11 and tunnel-receiving aperture 36 of wall 30 of tower 12. By re-orienting the relative positions of playhouse 11 and tower 12, tunnel assembly 15 may also extend, at a lower position, between playhouse wall 17 and tower wall 29 by communicating with tunnel-receiving aperture 23 of wall 17 and tunnel-receiving aperture 33 of wall 29. It should be noted that when in either of these lower positions, because of the manner in which tunnel assembly 15 is connected to playhouse 11 and tower 12, to be hereinafter described, one of flat outer tunnel surfaces 68 or 81 is always on top. As such, a safe walking or crawling surface is provided for the child should the child choose to move from playhouse 11 to tower 12 other than through tunnel assembly 15. Thus, for example, as shown in FIG. 1, the child could pass from playhouse 11 to tower 12 by moving through window 22 of wall 17, onto tunnel assembly 15, through tunnel-receiving aperture 35 of tower wall 30, and onto platform 43 in tower 12.

The third option for the attachment of tunnel assembly 15 is to have it extend between tunnel-receiving aperture 20 of playhouse wall 16 to upper tunnel-receiving aperture 35 of tower wall 30. When in this position, as a safety factor, the curved surfaces 69 and 82 or 70 and 83 are always on top, because of the manner in which tunnel assembly 15 is connected to apertures 20 and 35, to be hereinafter described, so that the child cannot crawl or walk on this elevated surface. It should be observed that aperture 35 of tower wall 30 is somewhat higher than aperture 20 of playhouse wall 16 because of the curved wall configurations of tunnel assembly 15. As such, the added feature of a slightly uphill or downhill tunnel travel is provided.

Figure 8:
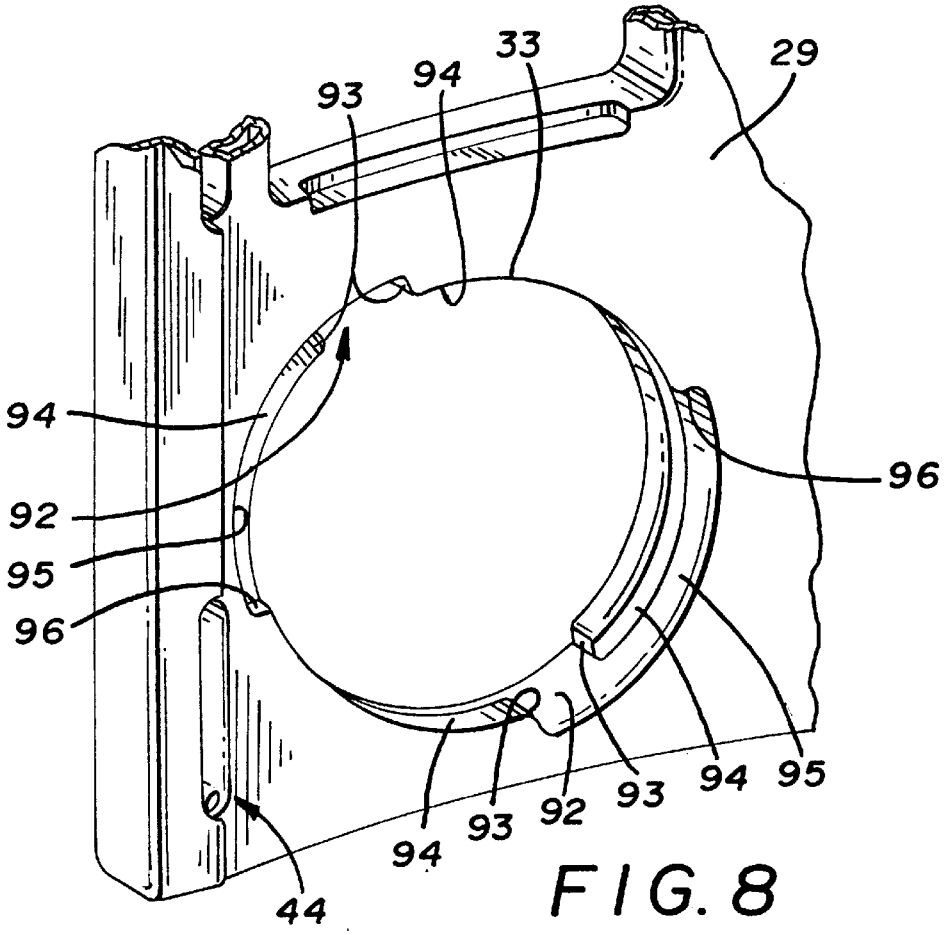
FIG. 8 is a fragmented rear or inside perspective view of the opening in one of the walls of either of the structures shown in FIGS. 2 and 3, the opening receiving the end of the tunnel shown in FIG. 7.

The manner in which tunnel assembly 15 is attached to any of the walls, as just described, is best described with reference to FIG. 8 which shows the details of a typical lower tunnel-receiving aperture, for example, aperture 33 in tower wall 29, all three lower tunnel-receiving apertures 20, 33 and 36 being identical. FIG. 8 shows wall 29 and aperture 33 as seen from the inside of tower 12. Aperture 33 is circular in configuration and is provided with two diametrically opposed notches 92 which extend entirely through wall 29. Notches 92 are defined by the edges 93 of laterally offset ledges 94 each of which extend from notches 92 and approximately ninety degrees around the opening of aperture 33. Ramped surfaces 95 are formed behind ledges 94, that is, they face inwardly of tower wall 29. Ramped surfaces begin at notches 92 and terminate at stop surfaces 96.

To attach the end of tunnel assembly 15 shown in FIG. 7 to wall 29, lug assemblies 91 are inserted through notches 92 until flange 64 abuts the outside of wall 29. Tunnel assembly 15 is then rotated clockwise by the user (seen as counterclockwise in FIG. 8), and lug assemblies 91 move along ramped surfaces 95 until they engage stop surfaces 96 at which time tunnel assembly 15 is attached to wall 29 with a flat surface 68 or 81 facing upwardly, as previously described. The other end of tunnel assembly 15 may then be inserted into aperture 23 of playhouse wall 17 in the same fashion by maneuvering tower wall 29 with the tunnel assembly attached thereto relative to playhouse all 17. Of course, the same assembly procedure is utilized to connect tunnel assembly 15 between aperture 36 of tower wall 30 and aperture 23 of playhouse wall 17.

That same procedure is also utilized to connect tunnel assembly 15 at its possible upper position, that is, between aperture 20 of playhouse wall 16 and aperture 35 in tower wall 30. But as can be seen in FIGS. 1 and 2, notches 92 in apertures 20 and 35 are oriented ninety degrees from those notches 92 in apertures 23, 33 and 36. As such, when tunnel lug assemblies 91 are inserted therethrough, and rotated as previously described, curved surfaces 69 and 82 or 70 and 83 will be facing upwardly.

As previously described, playground assembly 10 is also shown as being provided with two slides 13 and 14. The slide 13 shown is intended to be mounted only in the position shown in FIG. 1, that is, it can be connected in a conventional snap fit arrangement (not shown) to brace 40 of wall-like structure 32. Access to slide 13 from tower 12 is thus gained through opening 41. Slide 13 includes conventional side rails 97 with a sloping slide surface 98 therebetween.

Figure 9:
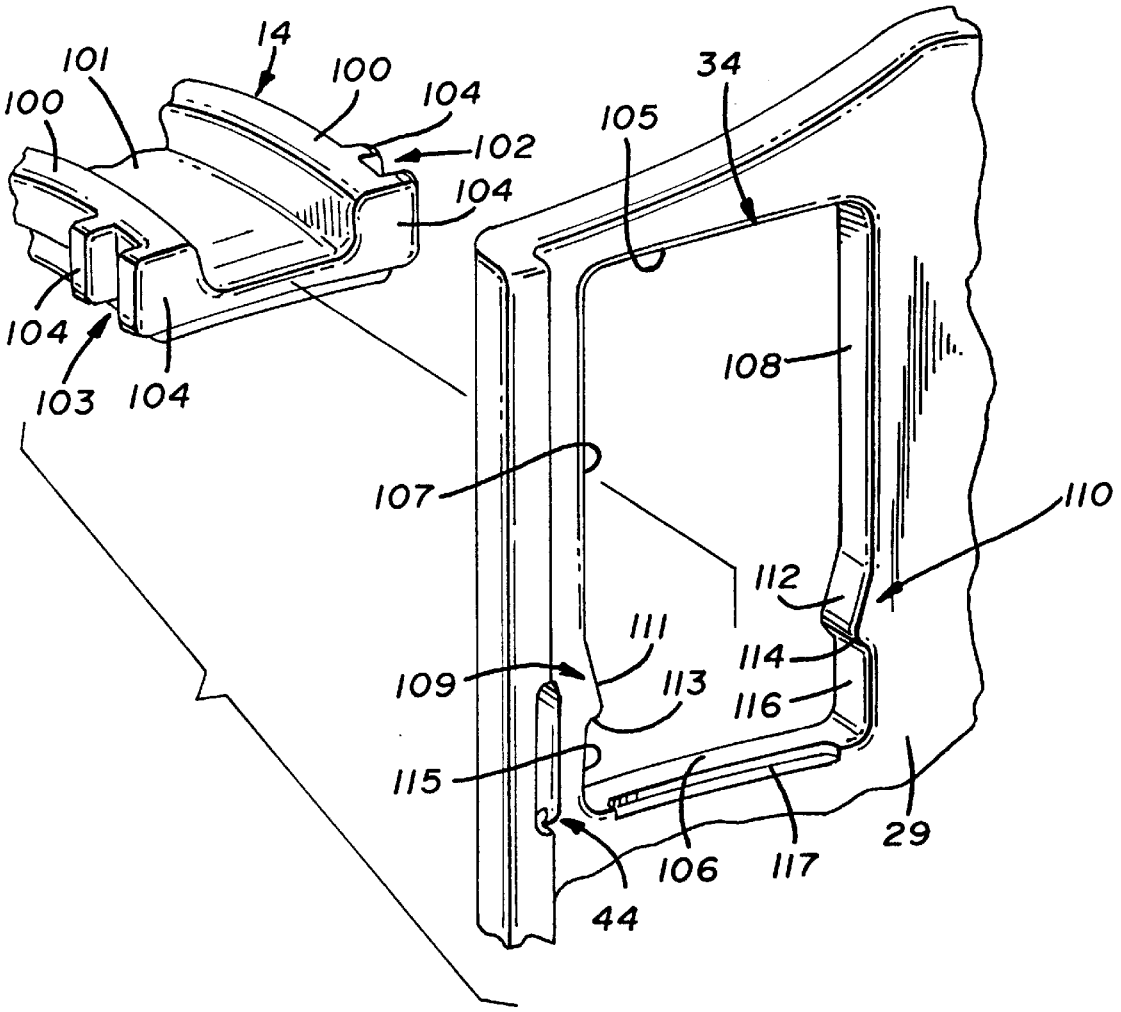
FIG. 9 is an exploded perspective view of a portion of a slide and a portion of one of the walls of either of the structures shown in FIGS. 2 and 3, showing the area thereof which receives the portion of the slide.

Slide 14, however, is positionable at multiple locations on playground assembly 10. Specifically, slide 14 may be positioned adjacent to window 26 of playhouse wall 19, as shown in FIG. 1, or it may be positioned adjacent to window 34 of tower wall 29 or adjacent to window 37 of tower wall 31. The manner in which slide 14 is attached to these windows is best shown in FIG. 9 where wall 29 and its slide-receiving window is seen from the rear or the inside of tower 12, it being understood that windows 26 and 37 of walls 19 and 31, respectively, are identical to that which is shown in FIG. 9.

Like slide 13, slide 14 includes conventional side rails 100 with a sloping slide surface 101 therebetween. U-shaped channels 102, 103 are provided at the upper end of side rails 100 and each include spaced arms 104 extending outwardly from rail 100 thereby forming, with rail 100, the generally U-shape.

Window 34, of course, extends through wall 29 and as opposed upper and lower walls 105 and 106, respectively, and opposed side walls 107 and 108, respectively. Ramped lugs, generally indicated by the numerals 109 and 110, extend inwardly from window side walls 107 and 108, respectively. Each lug 109, 110 includes an upper ramp surface, 111 and 112, respectively, which slopes inwardly as it extends downwardly. Each ramp surface 111, 112, terminates at its lower end as a lock surface 113, 114, respectively, which are shorter than ramp surfaces 111 and 112 and which slope back to side walls 105 and 106 at an angle closer to ninety degrees than the slope of ramp surfaces 111 and 112. Since lugs 109 and 110 are near the bottom of side walls 107 and 108, smaller side wall areas 115, 116 are formed beneath lugs 109 and 110. A hand-hold slot 117 can be formed near the lower wall 106 of window 34 so that a child may be assisted in climbing through window 34. However, slot 117 will not be exposed when slide 14 is attached to window 34 in a manner now to be described.

Slide 14 may be installed in one of two basically identical manners. It may be tilted and either channel 102 may be positioned under lug 110 with wall area 116 being partially received between arms 104 thereof or channel 103 many be positioned under lug 109 with wall area 115 being partially received within arms 104 thereof. Assuming that it has been tilted so that channel 102 is positioned under lug 110, then channel 103 is pushed downwardly on ramp surface 111 of lug 109 until it snaps under lock surface 113. At this time, wall areas 115 and 116 are both snugly received within channels 103 and 102, respectively, and slide 14 is attached to window 34. Pulling up on either rail 100 of slide 14, near the area of channels 102 and 103, will overcome the locking force of surfaces 113 and 114 and slide 14 can thereby be readily removed from window 34 for placement, as desired, on one of the other identical windows. It should be evident that for a snug fit between slide 14 and window 34, the space between slide arms 104 should approximate the depth of window side walls 107 and 108 and the height of slide arms 104 should approximate the height of window side wall areas 115, 116.

From the foregoing, it should be evident that a playground assembly constructed in accordance with the above description, substantially improves the art and otherwise accomplishes the objects of the present invention.

We claim:

1. A playground assembly comprising a first structure having a plurality of walls, a second structure having a plurality of walls, and a tunnel member selectively attachable between more than one of said plurality of walls of said first structure and more than one of said plurality of walls of said second structure, said more than one of each said plurality of walls being provided with at least one circular aperture therein, said aperture having diametrically opposed notches formed therein, the ends of said tunnel member being circular and having diametrically opposed lug assemblies formed thereon to be received in said notches, each said aperture including a ramp surface having a stop surface at the end thereof such that upon rotation of said tunnel member relative to said selected of said walls, said lug assemblies move on said ramp surface and engage said stop surface.

2. A playground assembly according to claim 1 wherein said tunnel member includes opposed generally flat surfaces and opposed generally curved surfaces.

3. A playground assembly according to claim 1 wherein said tunnel member is formed from a first portion and a second portion.

4. A playground assembly according to claim 3 wherein said first portion of said tunnel member includes tabs and said second portion of said tunnel member includes flaps to receive said tabs.

5. A playground assembly according to claim 4 wherein said tabs carry a lock barb and said flaps have notches, said lock barbs being received in said notches to attach said tunnel portions together to form said tunnel member.

6. A playground assembly according to claim 1 wherein one of said walls of said first structure is provided with an aperture near the top thereof, and one of said walls of said second structure is provided with an aperture near the top thereof, said tunnel member being connectable between said apertures near the top of said walls.

7. A playground assembly according to claim 6 wherein one of said walls of said first structure is provided with an aperture near the bottom thereof, and at least one of said walls of said second structure is provided with an aperture near the bottom thereof, said tunnel member being connectable between said apertures near the bottom of said walls.

8. A playground assembly according to claim 7 wherein said tunnel member includes a body portion having opposed generally flat walls and opposed generally curved walls such that when said tunnel member is connected between said apertures near the top of said walls, a said generally curved wall is facing upwardly and when said tunnel member is connected between said apertures near the bottom of said walls, a said generally flat wall is facing upwardly.

9. A playground assembly according to claim 1 wherein selected of said walls of said first and second structures are provided with windows, and further comprising a slide member attachable to one of said windows.

10. A playground assembly according to claim 9 wherein one of said walls of said structures is provided with a brace member, and further comprising a second slide member attached to said brace member.

11. A playground assembly according to claim 10 wherein said brace member includes a platform extending from said one of said walls and into said structure having said brace member.

12. A playground assembly comprising a first structure having a plurality of walls, a second structure having a plurality of walls, a tunnel member selectively attachable between more than one of said plurality of walls of said first structure and more than one of said plurality of walls of said second structure, windows formed in selected of said walls of said first and second structures, each said window having lugs, a slide member attachable to one of said windows, said slide member including generally U-shaped channels formed by spaced arms, said channels being received over said lugs such that said slide member may be attached to said selected of said walls having said windows.

13. A playground assembly according to claim 1 wherein each said structure includes four walls and further comprising means to interconnect said four walls.

14. A playground assembly according to claim 13 wherein said means to interconnect includes tabs formed on two of said walls and slots formed in two of said walls, said walls having said tabs being adjacent to said walls having said slots, said tabs being received in said slots.

15. A playground assembly according to claim 14 wherein each said slot includes opposed, offset ribs, said tabs having tracks to receive said ribs.

16. A playground assembly comprising a first structure having four walls, a second structure having four walls, means to interconnect said four walls of each said structure, and a tunnel member selectively attachable between more than one of said walls of said first structure and more than one of said walls of said second structure, said means to interconnect including tabs formed on two of said walls of each said structure and slots formed in two of said walls of each said structure, said walls having said tabs being adjacent to said walls having said slots, said tabs being received in said slots, each said slot including opposed, offset ribs, said tabs having tracks to receive said ribs, one of said ribs having a lug and one of said tracks having a hook, said hook engaging said lug to attach adjacent of said walls.

17. A playground assembly according to claim 1 wherein one of said plurality of walls of said first structure includes an aperture near the top thereof to receive said tunnel member.

18. A playground assembly according to claim 17 wherein a second of said plurality of walls of said first structure includes an aperture near the bottom thereof to receive said tunnel member.

19. A playground assembly according to claim 18 wherein a third of said plurality of walls of said first structure includes a window and further comprising a slide member attachable to said window.

20. A playground assembly according to claim 19 wherein one of said plurality of walls of said second structure includes an aperture near the top thereof to receive said tunnel member and an aperture near the bottom thereof to receive said tunnel member.

21. A playground assembly according to claim 20 wherein a second of said plurality of walls of said second structure includes an aperture near the bottom thereof to receive said tunnel member and a window above said aperture in said second wall of said second structure to receive said slide member.

22. A playground assembly according to claim 21 wherein a third of said plurality of walls of said second structure includes a window to receive said slide member.

23. A playground assembly comprising a first structure having a plurality of walls, a second structure having a plurality of walls, and a slide member selectively attachable to more than one of said walls of said plurality of walls of said first and second structures, said more than one of said walls being provided with a window, said window including opposed lug members to engage said slide member, each said lug member including a ramp surface and a lock surface, said slide member including generally U-shaped channels formed by spaced arms, said channels being adapted to slide down said ramp surfaces until said slide member is engaged by said lock surfaces.

24. A playground assembly according to claim 23 wherein more than one of said plurality of walls of said first structure and more than one of said plurality of walls of said second structure are provided with an aperture and further comprising a tunnel member attachable to said apertures.

25. A playground assembly according to claim 23 wherein one of said walls of said structures is provided with a brace member, and further comprising a second slide member attached to said brace member.

26. A playground assembly comprising a first structure having a plurality of walls, a second structure having a plurality of walls, a first aperture formed near the top of one of said walls of said first structure, a second aperture formed near the top of one of said walls of said second structure, a third aperture formed near the bottom of one of said walls of said first structure, a fourth aperture formed near the bottom of one of said walls of said second structure, and a tunnel member having lug assemblies thereon, said tunnel member including a body portion having at least one flat wall and at least one curved wall, said first and second apertures having notches formed therein at a first position, said third and fourth apertures having notches formed therein at a second position, such that when said lug assemblies are inserted into said notches of said first and second apertures and said tunnel member is attached to said structure, said curved wall is facing upwardly, and when said lug assemblies are inserted into said notches of said third and fourth apertures and said tunnel member is attached to said structures, said flat wall is facing upwardly whereby the user is discouraged from moving on said tunnel member when said tunnel member is connected between said first and second apertures.

* * * * *